US007589677B2

(12) United States Patent
Chen

(10) Patent No.: US 7,589,677 B2
(45) Date of Patent: Sep. 15, 2009

(54) WIRELESS ELECTRONIC PRODUCT WITH STEP-SHAPED WIDEBAND ANTENNA

(75) Inventor: Po-Chuan Chen, Hsinchu (TW)

(73) Assignee: Alpha Networks, Inc., Hsinchu (TW)

( * ) Notice: Subject to any disclaimer, the term of this patent is extended or adjusted under 35 U.S.C. 154(b) by 17 days.

(21) Appl. No.: 12/076,468

(22) Filed: Mar. 19, 2008

(65) Prior Publication Data

US 2009/0115667 A1 May 7, 2009

(30) Foreign Application Priority Data

Nov. 7, 2007 (TW) ..... 96141999 A

(51) Int. Cl.
*H01Q 1/38* (2006.01)

(52) U.S. Cl. ..... 343/700 MS; 343/702; 343/850

(58) Field of Classification Search ..... 343/700 MS, 343/702, 846, 848, 850
See application file for complete search history.

(56) References Cited

U.S. PATENT DOCUMENTS 5,828,340 A * 10/1998 Johnson ..... 343/700 MS
6,809,687 B2 * 10/2004 Yuanzhu ..... 343/700 MS

* cited by examiner

*Primary Examiner*—Hoang V Nguyen
(74) *Attorney, Agent, or Firm*—Bacon & Thomas, PLLC

(57) ABSTRACT

This invention is a wireless electronic product including a printed circuit board and a signal line installed at an end of the printed circuit board, wherein a wideband antenna is installed on the printed circuit board and has a shape extending from an another end of the printed circuit board towards the central position of the printed circuit board to form a symmetrical step-shaped antenna, and a microstrip feedline is extended from an end of the wideband antenna away from the another end of the printed circuit board and coupled with the signal line, such that the current produced by microstrip feedline due to an electro-inductive effect can flow along a step-shaped path on both sides of the wideband antenna, and the current can be distributed uniformly on the wideband antenna to effectively reduce the electro-inductive effect of the microstrip feedline.

10 Claims, 6 Drawing Sheets

WIRELESS ELECTRONIC PRODUCT WITH STEP-SHAPED WIDEBAND ANTENNA

FIELD OF THE INVENTION

The present invention relates to a wireless electronic product, and more particularly to a wireless electronic product with a step-shaped wideband antenna.

BACKGROUND OF THE INVENTION

As wireless electronic products are manufactured with a short, small, light and thin design, the space within a casing of the wireless electronic product is decreased greatly, and the area reserved on a printed circuit board of the wireless electronic product for installing an antenna becomes very small, and thus research and development engineers and manufacturers attempt to print antennas in different shapes (such as a circular or polygonal shape) on the printed circuit board, and try to find an antenna with the most appropriate shape and size and having a lower cost and an easy-to-adjust feature. However, no antenna with the aforementioned conditions has been designed on a printed circuit board yet, mainly because the production conditions such as the mass production and the high production yield rate have to be taken into consideration for the actual production of the antennas.

Based on the foregoing reasons, designers and manufacturers designed and developed a microstrip bell-shaped antenna as shown in FIG. 1, wherein electronic components and circuits of a wireless electronic product are installed on a printed circuit board 1 of the wireless electronic product, and the printed circuit board 1 has a bell-shaped antenna 10 printed at a position adjacent to an end of the printed circuit board 1, and both sides of the bell-shaped antenna 10 are expanded towards both sides of the printed circuit board 1, and a microstrip feedline 12 is extended to a position adjacent to an another end of the printed circuit board 1, and an end of the microstrip feedline 12 is connected to a signal line (not shown in the figure) of the printed circuit board 1, such that the outwardly extended shape of the bell-shaped antenna 10 allows the current produced by the microstrip feedline 12 due to an electro-inductive effect to flow along a tapered path on both sides of the bell-shaped antenna 10, and the current can be distributed uniformly on the bell-shaped antenna 10 to effectively reduce the electro-inductive effect of the microstrip feedline 12 and provide the required bandwidth. Since the bell-shaped antenna 10 can be printed directly onto the printed circuit board 1, the bell-shaped antenna 10 can meet the requirements for mass productions and a high yield of the production.

For example, the maximum width of the bell-shaped antenna as shown in FIG. 1 is equal to 17.87 mm; the maximum length is equal to 15.558 mm; and the bandwidth falls within a range of 1.912059 GHz~4.967982 GHz (as shown in FIG. 2) to cover the frequency required by a ultra wideband (UWB) wireless electronic product. However, some wireless electronic products designed according to customer requirements have narrow space in their casing, such that after the positions of electronic components and circuits on the printed circuit board are adjusted, the area reserved on the printed circuit board for printing the bell-shaped antenna is insufficient. Therefore, finding a way of manufacturing an antenna with a bandwidth and electric properties similar to those of the bell-shaped antenna demands immediate attentions and feasible solutions.

SUMMARY OF THE INVENTION

In view of the problems and shortcomings of the prior art, the inventor of the present invention based on years of experience in the related industry to conduct extensive researches and experiments, and finally developed a wireless electronic product with a step-shaped wideband antenna in accordance with the invention to effectively overcome the aforementioned shortcomings of the prior art, such that the antenna with a smaller size and a bandwidth and electric properties similar to those of a traditional bell-shaped antenna can be printed onto a printed circuit board to solve the problem of unable to print the traditional bell-shaped antenna onto an even smaller area reserved on the printed circuit board.

It is a primary objective of the present invention to provide a wireless electronic product with a step-shaped wideband antenna, wherein a printed circuit board is installed on a wireless electronic product, and the printed circuit board has a connector installed at an end of the top surface of the printed circuit. The step-shaped wideband antenna comprises a wideband antenna and a microstrip feedline, wherein the wideband antenna is disposed on the top surface of the printed circuit board, and the shape of the wideband antenna is extended from an another end of the printed circuit board towards the central position of the printed circuit board to form a tapered step-shaped antenna symmetrically on both sides, and the microstrip feedline is extended from an end of the wideband antenna away from the another end of the printed circuit board and coupled with the signal line, such that the current produced by microstrip feedline due to an electro-inductive effect flows along a zigzag step-shaped path on both sides of the wideband antenna, and the current can be distributed uniformly on the wideband antenna to effectively reduce the electro-inductive effect of the microstrip feedline, so as to provide a bandwidth condition similar to the traditional bell-shaped antenna and make the distance between both ends of the wideband antenna smaller than the distance between both ends of the traditional bell-shaped antenna to effectively miniaturize the antenna.

To make it easier for our examiner to understand the shape, structure, design principle and performance of the present invention, we use a preferred embodiment together with the attached drawings for the detailed description of the invention as follows:

DETAILED DESCRIPTION OF THE PREFERRED EMBODIMENTS

Figure 1:
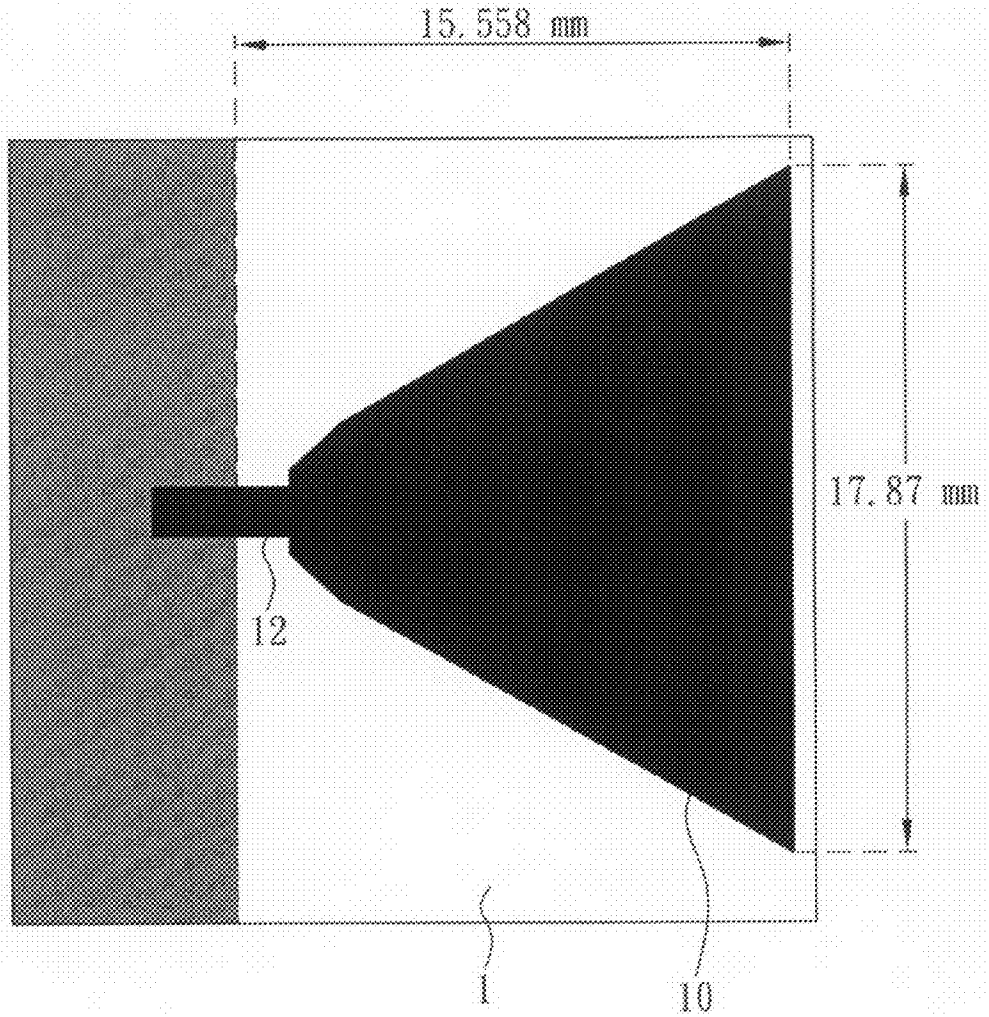
FIG. 1 (Prior Art)
FIG. 1 is a schematic view of a bell-shaped antenna of a wireless electronic product in accordance with a prior art.
Figure 2:
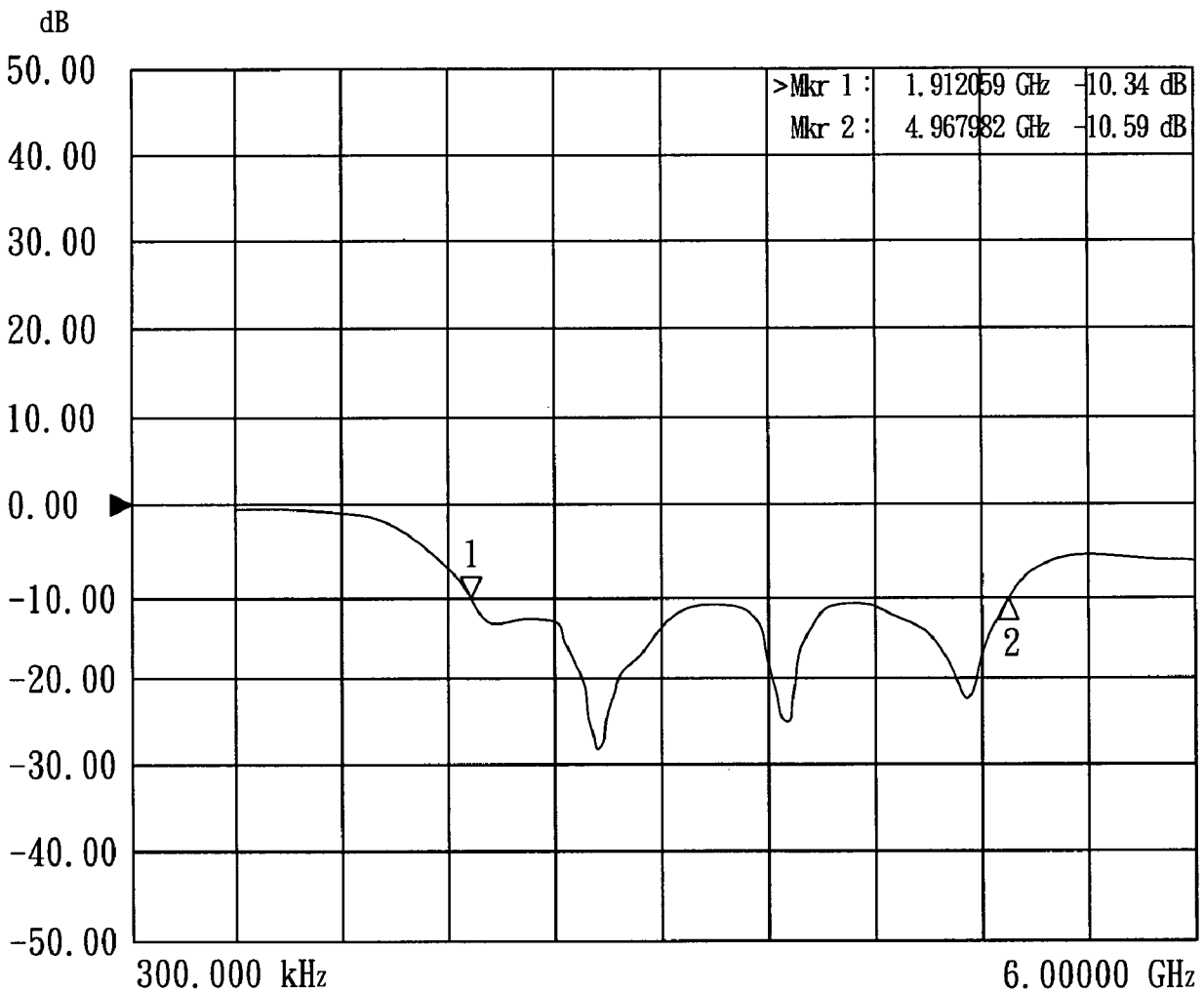
FIG. 2 (Prior Art)
FIG. 2 is a schematic view of an actual measured frequency range of a bell-shaped antenna as depicted in FIG. 1.
Figure 3:
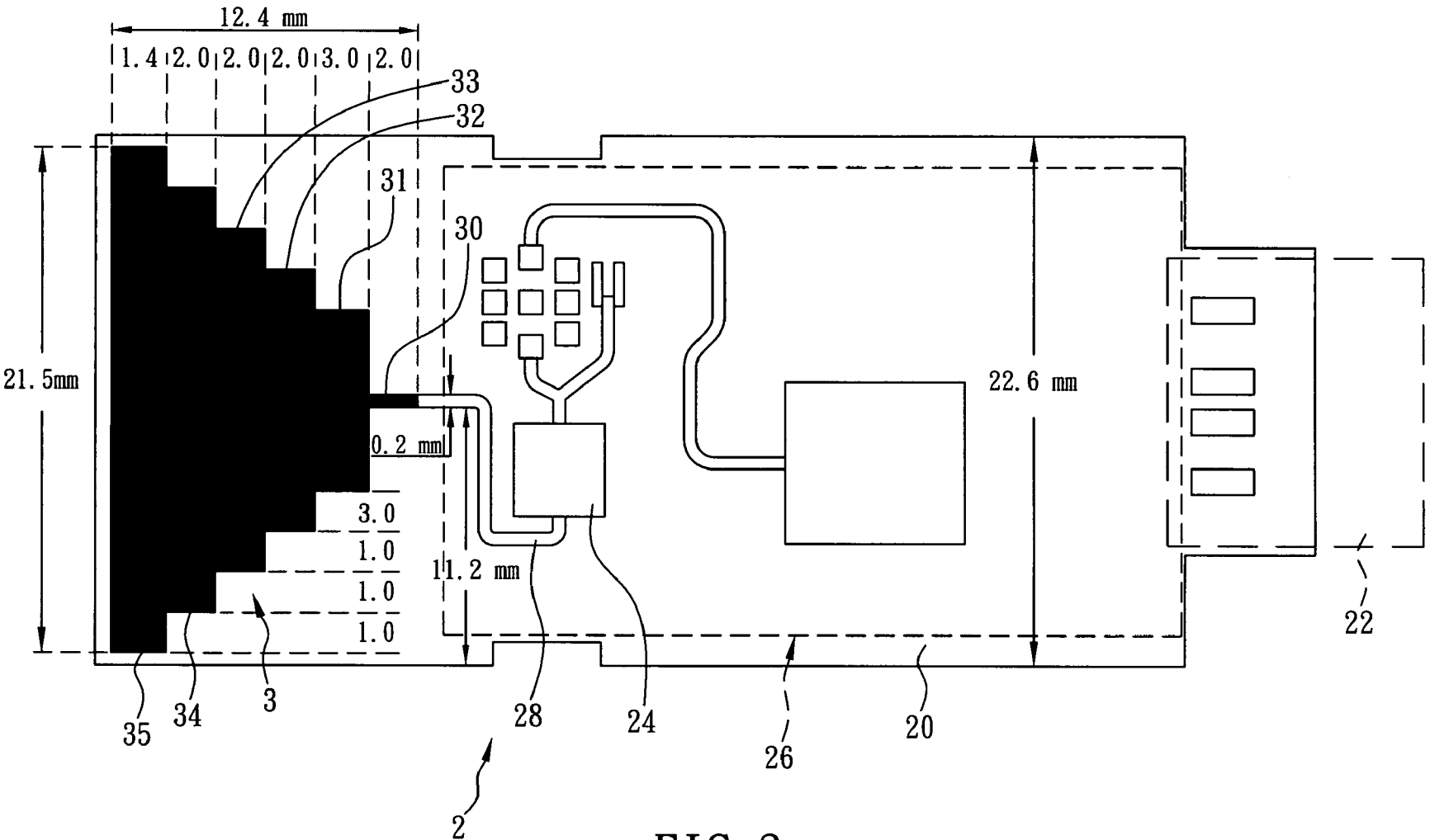
FIG. 3 is a schematic view of a wireless electronic product with a step-shaped wideband antenna in accordance with the present invention.

Referring to FIG. 3 for a wireless electronic product with a step-shaped wideband antenna, a printed circuit board 20 is installed in a wireless electronic product 2, and the printed circuit board 20 includes a connector 22 disposed at an end of the top surface of the printed circuit board 20, a signal transceiving loop 24 disposed at the top surface of the printed circuit board 20 and adjacent to the central position of the printed circuit board 20, a conducting wire extended from the signal transceiving loop 24 in a direction to the another end of the printed circuit board 20 to serve as a signal line 28, and a ground plane 26 (as shown in a frame of dotted line in FIG. 3) disposed at the bottom surface of the printed circuit board 20 and at a position corresponding to the signal transceiving loop 24 and the signal line 28, wherein the top surface of the printed circuit board 20 has a wideband antenna 3, and the shape of the wideband antenna 3 is formed by extending from the another end of the printed circuit board 20 towards the central position of the printed circuit board 20 to form a tapered step-shaped antenna symmetrically on both sides, and a microstrip feedline 30 is extended from an end of the wideband antenna 3 away from the another end of the printed circuit board 20 and coupled with the signal line 28. If the microstrip feedline 30 produces a current due to the electro-inductive effect, the current will flow along the zigzag step-shaped path of both sides of the wideband antenna 3, so that the current can be distributed uniformly on the wideband antenna 3 to effectively reduce the electro-inductive effect of the microstrip feedline 30 and provide a bandwidth condition similar to the traditional bell-shaped antenna, and the distance between both ends of the wideband antenna 3 is smaller than the distance between both ends of the traditional bell-shaped antenna in order to effectively miniaturize the antenna.

In this invention, no metal exists around the periphery of the wideband antenna, so that the valid bandwidth of the wideband antenna 3 can be adjusted to a frequency band range required by various different products without installing an additional matching circuit, and thus the invention can effectively improve the tolerance of mass productions and provide a casing design that fits different products.

Referring to FIG. 3 for a preferred embodiment of the present invention, the width of the printed circuit board 20 is equal to 22.6 mm, and the length from an end of the signal line 28 to the another end of the printed circuit board 20 is equal to 13.2 mm, and the length of the microstrip feedline 30 extended from an end of the ground plane 26 adjacent to the another end of the printed circuit board 20 to the end of the wideband antenna 3 away from the another end of the printed circuit board 20 is equal to 2.0 mm. Further, both sides of the wideband antenna 3 form symmetric first to fifth step portions 31, 32, 33, 34, 35 from the corresponding position adjacent to the ground plane 26 to both sides of the another end of the printed circuit board 20.

It is noteworthy to point out that both ends of the first to fifth step portions 31, 32, 33, 34, 35 of the preferred embodiment are substantially right-angled. However, the implementation of the present invention is not limited to such arrangement only. Regardless of the shape (such as a bending angle or an inclined angle) of the step portions 31, 32, 33, 34, 35, the step portions referred by this invention are in step shapes each with an extendable length at both sides of the wideband antenna 3.

Further, the width of first step portion 31 extended from the microstrip feedline 30 to both sides of the printed circuit board 20 is equal to 4.65 mm, and the length extended towards the another end of the printed circuit board 20 is equal to 3.0 mm, and the width of the second step portion 32 extended from a position adjacent to the first step portion 31 to both sides of the printed circuit board 20 is equal to 3.0 mm, and the length extended towards the another end of the printed circuit board 20 is equal to 3.0 mm, and the width of the third step portion 33 and the fourth step portion 34 extended from a position adjacent to a previous step portion to both sides of the printed circuit board 20 is equal to 1.0 mm, and the length extended towards the another end of the printed circuit board 20 is equal to 2.0 mm, and the width of the fifth step portion 35 extended from a position adjacent to the fourth step portion 34 to both sides of the printed circuit board is equal to 1.0 mm, and the length extended to the another end of the printed circuit board 20 is equal to 1.4 mm.

Figure 4:
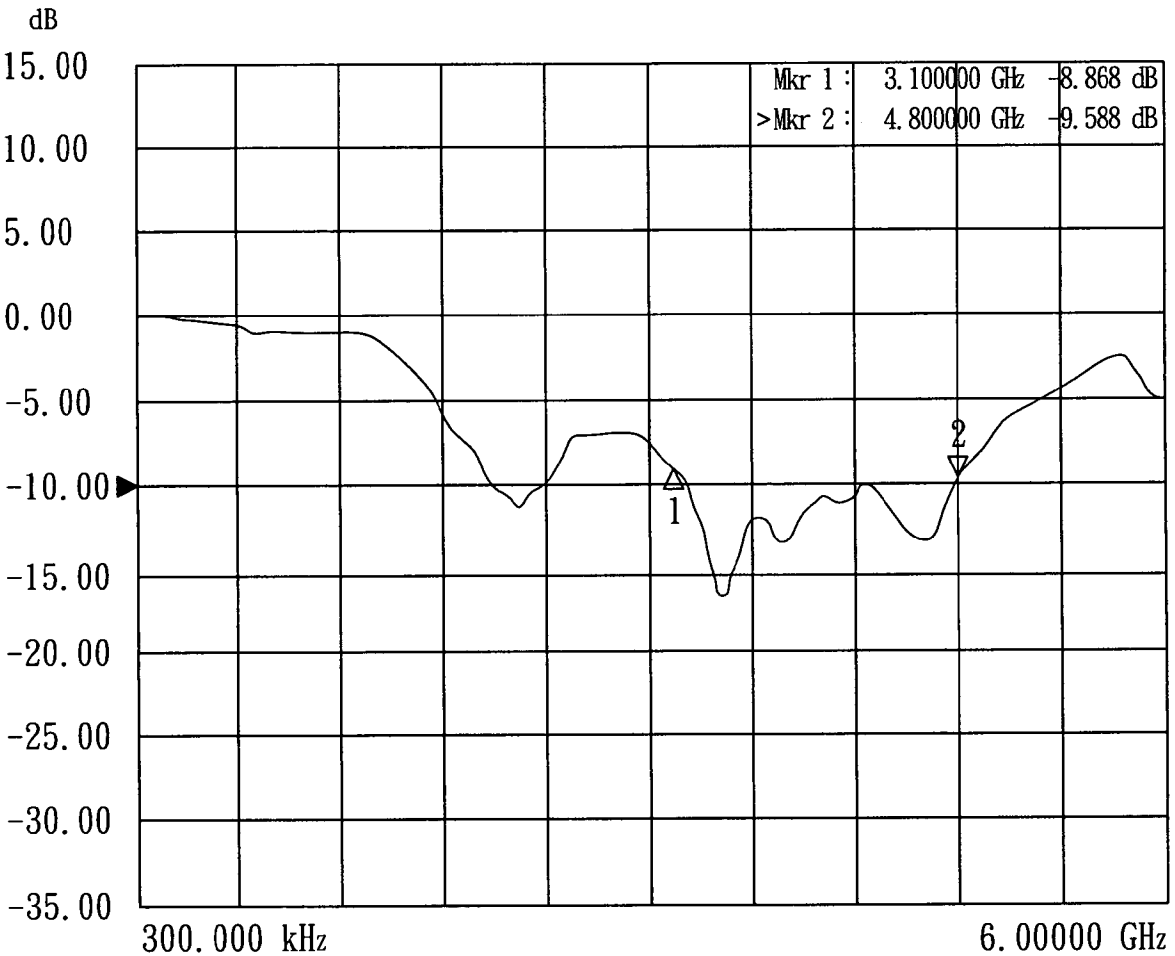
FIG. 4 is a schematic view of an actual measured frequency range of a step-shaped wideband antenna as depicted in FIG. 3.
Figure 5:
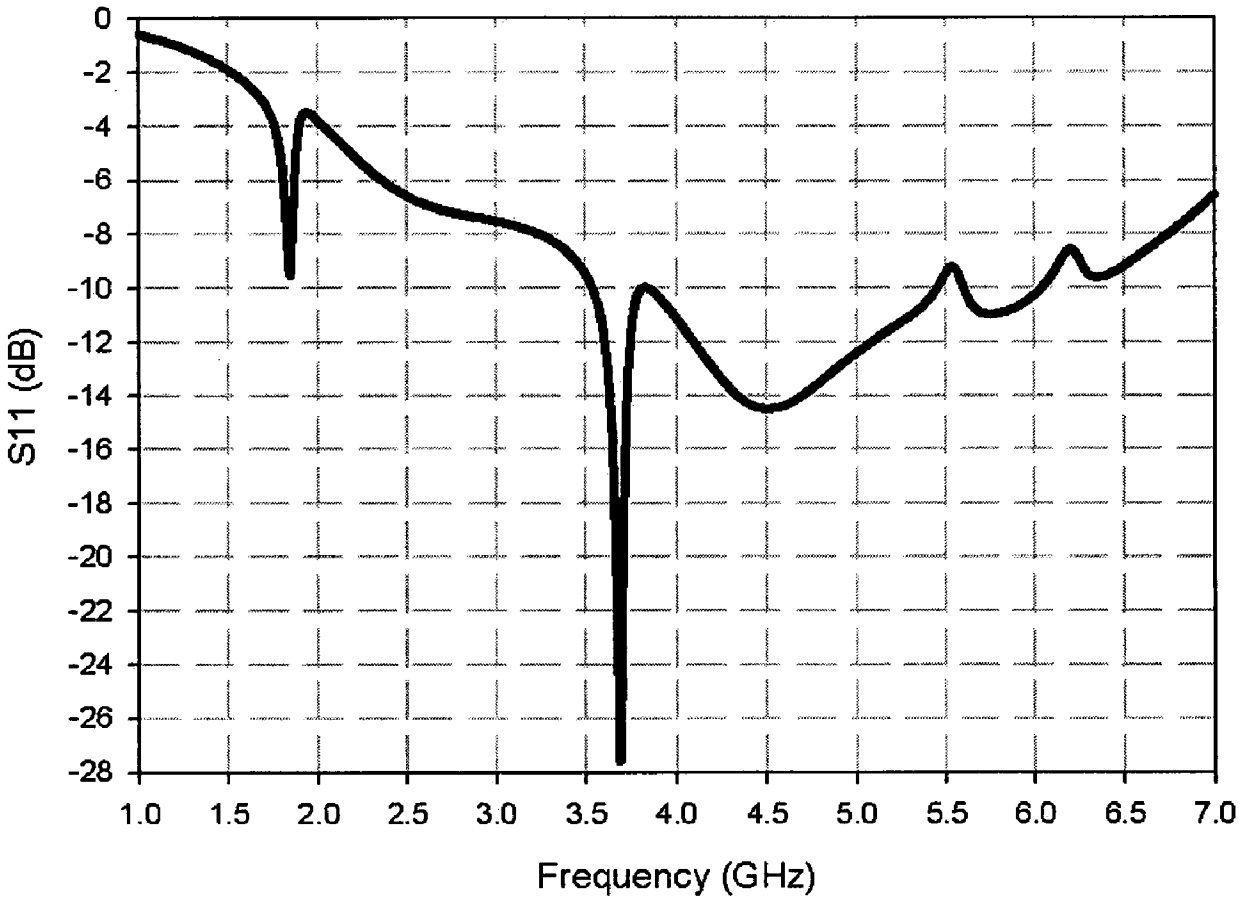
FIG. 5 is a schematic view of an actual measured frequency range of the step portions substantially in a bending angle in accordance with the present invention.
Figure 6:
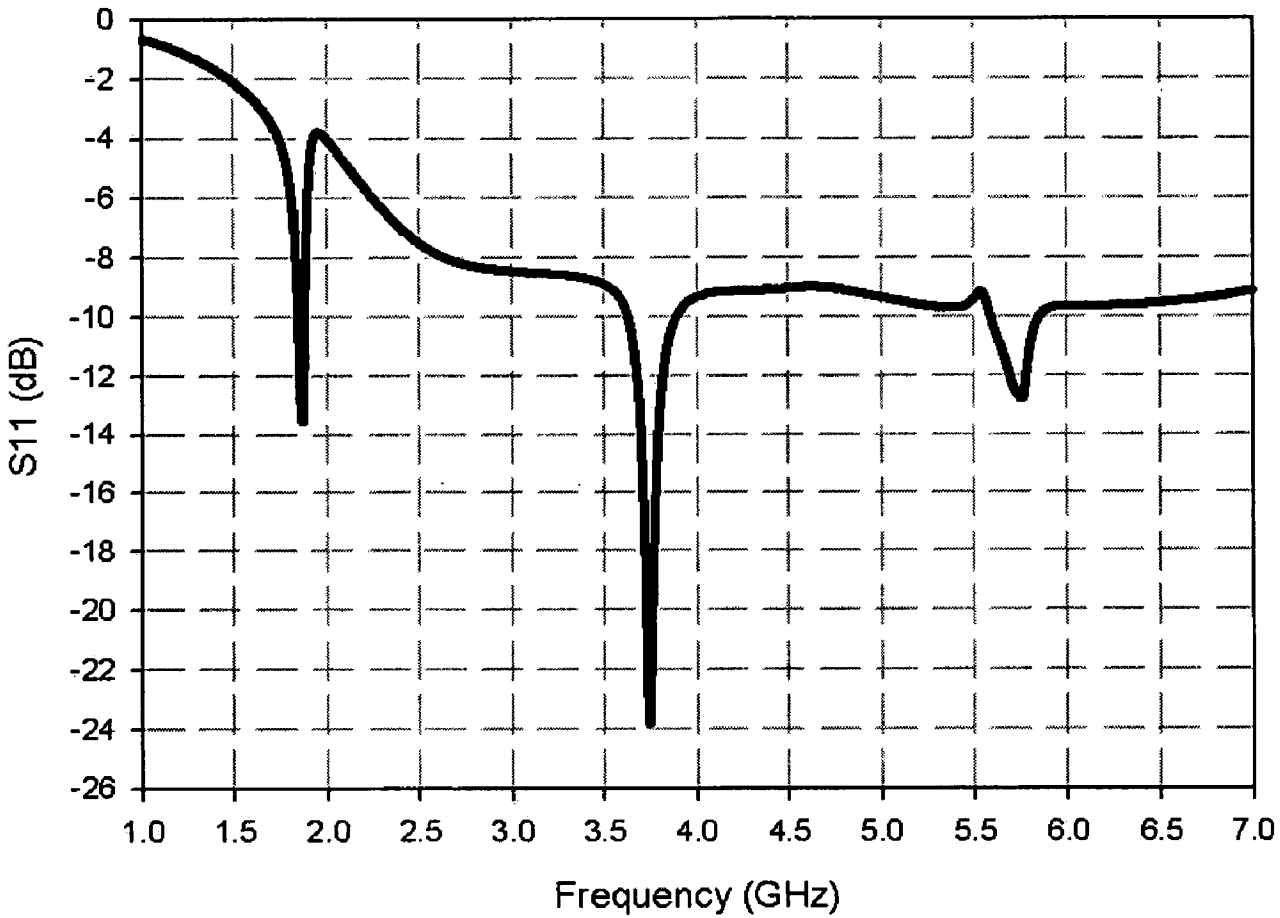
FIG. 6 is a schematic view of an actual measured frequency range of the step portions substantially in an inclined angle in accordance with the present invention.

From the description above, the total width of the step portions 31, 32, 33, 34, 35 and the microstrip feedline 30 is equal to 21.5 mm, and the total length of the step portions 31, 32, 33, 34, 35 and the microstrip feedline 30 is equal to 12.4 mm. In FIG. 4, the signal gain value of the step-shaped wideband antenna approaching a bandwidth range covered by −10 dB falls within a range of 3.1 GHz~4.8 GHz, which complies with the frequency range of a ultra wide band (UWB) wireless electronic product defined by the Federal Communication Commission (FCC). If the external shape of the step portions 31, 32, 33, 34, is in a bending angle as shown in FIG. 5, or the external shape of the step portions 31, 32, 33, 34, 35 is in an inclined angle as shown in FIG. 6, the signal gain value of the step-shaped wideband antenna approaching a bandwidth range covered by −10 dB falls within a range of 3.1 GHz~4.8 GHz, which also complies with the frequency range of a ultra wide band (UWB) wireless electronic product defined by the Federal Communication Commission (FCC).

In the comparison between the dimensions and the bandwidth range of the aforementioned step-shaped wideband antenna and the dimensions and the bandwidth range of the traditional bell-shaped antenna, the bandwidth ranges of both antennas comply with the frequency range of a ultra wide band (UWB) wireless electronic product defined by the Federal Communication Commission (FCC), but the length and width of the step-shaped wideband antenna of the invention are obviously smaller than the length and width of the traditional bell-shaped antenna, and thus the invention can transmit and receive with a bandwidth range similar to that of a bell-shaped antenna, and also can miniaturize the antenna effectively.

While the invention has been described by means of specific embodiments, numerous modifications and variations could be made thereto by those skilled in the art without departing from the scope and spirit of the invention set forth in the claims.

What is claimed is:

1. A wireless electronic product with a step-shaped wideband antenna, comprising:

a printed circuit board;

a signal transceiving loop, disposed at a top surface of the printed circuit board at a position adjacent to a central position of the printed circuit board;

a signal line, being a conducting wire extended from the signal transceiving loop;

a wideband antenna, disposed at a top surface of the printed circuit board, and having a shape extending from an end of the printed circuit board towards the central position of the printed circuit board to form a tapered step-shaped antenna symmetrically on both sides, and having an end at a position away from the end of the printed circuit board extended out to form a microstrip feedline having an end coupled with the signal line; and a ground plane, disposed on a bottom surface of the printed circuit board, and at a position corresponding to the signal transceiving loop and the signal line.

2. The wireless electronic product of claim 1, wherein both sides of the wideband antenna form a plurality of step portions, and the step portion adjacent to the microstrip feedline is extended to a distance from the microstrip feedline towards both sides of the printed circuit board, and further extended to a distance towards the end of the printed circuit board, and the other step portions are extended to a distance from an end of the previous step portion towards both sides of the printed circuit board, and further extended a distance towards the end of the printed circuit board, and a distance is separated between an end of the last step portion and the end of the printed circuit board, and the total width of the step portions and the microstrip feedline falls within the width of the printed circuit board, and the total length of the step portions and the microstrip feedline falls within a range from the end of the printed circuit board to the ground plane.

3. The wireless electronic product of claim 2, wherein both ends of the step portions are respectively right angle.

4. The wireless electronic product of claim 2, wherein both ends of the step portions are respectively at a bending angle.

5. The wireless electronic product of claim 2, wherein both ends of the step portions are respectively at an inclined angle.

6. A step-shaped wideband antenna, comprising:

a wideband antenna, installed at a top surface of a printed circuit board, and having a shape extending from an end of the printed circuit board towards a central position of the printed circuit board to form a tapered step-shaped antenna symmetrically on both sides; and a microstrip feedline, installed at a top surface of the printed circuit board, and having an end coupled to an end of the wideband antenna away from the end of the printed circuit board and an another end coupled to a signal line extended from the signal transceiving loop that is disposed on the top surface of the printed circuit board at a position adjacent to the central position of the printed circuit board.

7. The step-shaped wideband antenna of claim 6, wherein the wideband antenna forms a plurality of step portions on both sides of the wideband antenna, and the step portion adjacent to the microstrip feedline is extended to a distance from the microstrip feedline towards both sides of the printed circuit board, and further extended to a distance towards the end of the printed circuit board, and the other step portions are extended to a distance from an end of a previous step portion towards both sides of the printed circuit board, and further extended to a distance towards the end of the printed circuit board, and a distance is separated between the last step portion and the end of the printed circuit board, and the total width of the step portions and the microstrip feedline falls within the width of the printed circuit board, and the total length of the step portions and the microstrip feedline falls within a range from the end of the printed circuit board to the ground plane.

8. The step-shaped wideband antenna of claim 7, wherein both ends of the step portions are respectively right angle.

9. The step-shaped wideband antenna of claim 7, wherein both ends of the step portions are respectively at a bending angle.

10. The step-shaped wideband antenna of claim 7, wherein both ends of the step portions are respectively at an inclined angle.

* * * * *